US005829361A

United States Patent [19]

Fenton

[11] Patent Number: 5,829,361

[45] Date of Patent: Nov. 3, 1998

[54] SPACE SAVING NESTABLE SKELETAL PALLET

[76] Inventor: Michael Robert Fenton, c/-PO Box 22064, Otahuhu, Auckland, New Zealand

[21] Appl. No.: 849,061

[22] PCT Filed: Nov. 27, 1995

[86] PCT No.: PCT/NZ95/00124

§ 371 Date: Aug. 4, 1997

§ 102(e) Date: Aug. 4, 1997

[87] PCT Pub. No.: WO96/16872

PCT Pub. Date: Jun. 6, 1996

[30] Foreign Application Priority Data

Nov. 29, 1994 [NZ] New Zealand ..... NZ270021

[51] Int. Cl.[6] ..... B65D 19/38

[52] U.S. Cl. ..... 108/54.1; 108/51.11

[58] Field of Search ..... 108/53.3, 53.1, 108/53.5, 54.1, 56.11, 56.1

[56] References Cited

U.S. PATENT DOCUMENTS

| | | | |
|---|---|---|---|
| D. 256,007 | 7/1980 | Chillog . | |
| D. 306,226 | 2/1990 | Jirucha . | |
| 622,666 | 4/1899 | Burwell | 108/54.1 X |
| 1,317,550 | 9/1919 | Cass | 108/54.1 X |
| 2,377,911 | 6/1945 | Warren | 108/54.1 |
| 2,405,535 | 8/1946 | Weiss | 108/54.1 |
| 2,509,682 | 5/1950 | Golrick . | |
| 2,544,743 | 3/1951 | Vrabcak | 108/53.3 X |
| 2,615,661 | 10/1952 | Cushman | 108/53.3 |
| 3,643,988 | 2/1972 | Ingvartsen | 108/53.3 X |
| 3,878,796 | 4/1975 | Morrison . | |
| 4,145,974 | 3/1979 | Fleming et al. | 108/53.3 X |
| 4,714,026 | 12/1987 | Yamaguchi et al. | 108/51.3 X |
| 5,320,048 | 6/1994 | Feiner | 108/51.11 |
| 5,586,666 | 12/1996 | Squitieri | 108/54.1 X |

FOREIGN PATENT DOCUMENTS

| | | | |
|---|---|---|---|
| 255323 | 9/1962 | Australia . | |
| 48610/85 | 4/1986 | Australia . | |
| 67720/87 | 7/1987 | Australia . | |
| 548432 | 6/1956 | Belgium | 108/54.1 |
| 456529 | 11/1991 | European Pat. Off. | 108/53.3 |

*Primary Examiner*—Jose V. Chen

*Attorney, Agent, or Firm*—Jacobson, Price, Holman & Stern, PLLC

[57] ABSTRACT

A pallet approachable by tines from at least two directions, the pallet having a plurality of substantially parallel beams each fixed in lateral juxtaposition to any neighboring beams, the beams being linked by a structure above a bottom surface, the arrangement providing spacings into which the beams can substantially nest from below to allow a base to base nesting of beams of different pallets or self nesting of the same pallet upon folding in half, thereby to provide a reduction in the overall volume of any pairing of pallets or any individual foldable pallet respectively, each of the beams (by a transverse opening through each beam) can accommodate a pair of forks from opposite horizontal directions. Eight embodiments are disclosed. One plain flat pallet, one which folds in half, some with extensions which telescope into the beams, one with a collapsible cage, and others with various forms of the beam elements and the structure for linking therebetween. The pallet elements may be wood, metal, plastic or any combination thereof.

29 Claims, 27 Drawing Sheets

SPACE SAVING NESTABLE SKELETAL PALLET

TECHNICAL FIELD

The present invention relates to pallets.

BACKGROUND ART

Pallets are used to support bases which allow for access to fork tines under the support base so that a forklift can lift the support base and any product supported directly or indirectly by the support base.

Pallets are used extensively in the transport industry. The most common type of pallet used is the wooden pallet. Unfortunately there are a number of problems associated with wooden pallets including shortness of life. Another problem is that it has become expensive to return bulky wooden pallets to the country of origin on account of their size.

Attempts have been made from time to time to come up with pallets of different configurations and/or of different materials or mixtures of materials which will provide an alternative to the traditional wooden pallets. Other pallet types have been made from a variety of materials, including corrugated metal, wire mesh, aluminium, fibre board and plastics.

See for example U.S. Design Pat. Nos. 256,007, 306,226 and U.S. Pat. No. 2,405,535.

U.S. Pat. No. 2,405,535 (Le Roy Weiss) discloses an adjustable pallet which allows by means of its construction increases in size by fairly small increments to accommodate different size boxes or groupings of boxes. It primarily comprises a skeletal support base on three parallel runners, an outer runner of which is at a distal end of support base defining slats, beams or the like which intermesh and are moveable longitudinally relative to like slats, beams or the like fixed to span between the other two runners. The product therefore, in one degree of freedom, is telescopic down to a size not much larger than the area defined by the slats, beams or the like of the two runners which are fixed relative one to the other. Contraction/expansion telescopically in another degree of freedom, ie. normal to the longitudinal extent of said slats, beams or the like is also disclosed.

We recognise a potential market for pallet forms (assemblies as a bare pallet or modified to cage, bin or the like forms) which provide for flexibility of use and compliance with the national Standards of a number of different countries while preferably providing for ease of repair by substitution of components thereof as and when the need arises. An ability to repair greatly enhances pallet life and lowers ultimate cost.

The Standards of countries vary and by way of example various Standards provide for the following pallet sizes in millimeters—

TABLE 1

| | |
|---|---|
| NZ 2010:1970 | 800 × 1000 |
| | 800 × 1200 |
| | 1000 × 1200 |
| | 1200 × 1600 |
| | 1200 × 1800 |
| B.S. 2629:1989 | 1200 × 1000 |
| | 1200 × 800 |
| | 1140 × 1140 |
| ISO | 1000 × 1200 |
| | 1200 × 800 |
| | 800 × 1200 |
| | 1140 × 1140 |
| DIN 15 146 | 1000 × 1200 |
| | 800 × 1200 |
| | 800 × 600 |
| AUSTRALIAN AS 4068 | 1165 × 1165 |
| | 1100 × 1100 |
| JIS 0606 | 800 × 1100 |
| JIS 0604 | 1100 × 800 |
| | 900 × 1100 |
| | 1100 × 900 |
| | 1100 × 1100 |
| | 1100 × 1300 |
| | 1300 × 1100 |
| | 1100 × 1400 |
| | 1400 × 1100 |
| NOT RECOGNISED* | 1440 × 1130 |
| IN JIS 0604 | 800 × 1200 |
| | 1200 × 800 |
| | 1000 × 1200 |
| | 1200 × 1000 |

It can be seen even on bare pallet size that the Japanese Standard JIS 0604 does not allow sizes allowed in other countries.

TABLE 2

| NOM | STANDARD | DIM A | | DIM B | | DIM C | | DIM D | | DIM E | | DIM F | |
|---|---|---|---|---|---|---|---|---|---|---|---|---|---|
| SIZE | NO. | Max | Min | Max | Min | Max | Min | Max | Min | Max | Min | Max | Min |
| 1200 | B.S. 2629 PART 1 | 1203 | 1194 | | 770 | 150 | | | | 127 | | 28 | |
| 1000 | B.S 2629 PART 1 | 1006 | 997 | | 720 | 150 | | | | 127 | | 28 | |
| 1140 | B.S 2629 PART 1 | 1146 | 1137 | | 760 | 150 | | | | 127 | | 28 | |
| 1200 | NZS 2010 1970 | 1220 | 1200 | | 760 | 150 | | | | 127 | | 28 | |
| 1000 | NZS 2010 1970 | 1016 | 1000 | | 710 | 150 | | | | 127 | | 28 | |
| 1200 | DIN 146 | 1203 | 1197 | | 907 | 147 | 142 | 148 | | 126 | 121 | 23 | |
| 1200 | ISO 6780 1988 | 1200 | 1194 | | 770 | 150 | | | | 127 | | 28 | |
| 1165 | A.S 4068 1993 | 1170 | 1160 | | 860 | 430 | | 150 | | | 90 | | |

TABLE 2-continued

| NOM SIZE | STANDARD NO. | DIM A Max | DIM A Min | DIM B Max | DIM B Min | DIM C Max | DIM C Min | DIM D Max | DIM D Min | DIM E Max | DIM E Min | DIM F Max | DIM F Min |
|---|---|---|---|---|---|---|---|---|---|---|---|---|---|
| 1100 | A.S 4068 1993 | 1120 | 1100 | | 860 | 430 | | 150 | | | 90 | | |
| 1200 | JIS 1989 Z0604 | 1205 | 1195 | | | | | | | | 116 | | |
| 1200 | JIS Z0606 1993 | | | | | | | | | | 60 +F | | |

By reference to FIG. 28 annexed hereto which defines the dimensions A through F, Table 2 sets out for the Standards listed in Table 1 the divergent requirements as to dimensions A through F.

As can be seen therefore from Tables 1 and 2 hereinbefore there is great difficulty in rationalising the Standards from a number of different countries (all potential trading partners) in relation to tine receiving openings, pallet sizes etc. This is further exacerbated where a pallet form is required which is adjustable as to size owing to conflicting requirements concerning tine receiving opening size for the different adjusted pallet size. Such standards also create difficulties with any articulating form of pallet.

Diverse markets for pallets exist. On market exists for forms that might articulate to allow, for example, a sales representative to uplift and articulate a pallet that has been delivered, [for example, into a retail store] and to return of that pallet in his or her car since one pallet very seldom justifies a truck journey. There is also of course the more usual market for pallets where they are simply accumulated and returned in bulk or are reused for a return journey. Here of course adjustment as to size, an ability to be reduced in volume (eg by nesting) and of course an ability to have them repaired is of importance.

The present invention relates to an alternative pallet forms to any of those previously defined which reduces space required for the pallet upon its return when unloaded and/or which at least in some embodiments does allow the tailoring of the size of the pallet to a specific load to be carried thereon and/or which provides a repairable pallet (including cage, bin, etc.) assembly which provides a fair degree of compliance with the Standards of a number of countries.

DISCLOSURE OF INVENTION

The present invention relates to a pallet capable of being stably positioned on a horizontal surface (eg. the ground), of defining in use at least a skeletal support surface for a load and of defining a forklift or the like tine engageable surface or surfaces below said support surface and above any such horizontal surface approachable by tine(s) from at least two directions, each to allow the uplifting of said pallet from such a horizontal surface when in a load supporting condition, the pallet being characterised in that a plurality of substantially parallel beam or beam like assemblies, each fixed directly or indirectly in lateral juxtaposition to any neighbouring beam(s) or beam assembly(assemblies), define said support surface (at least in part) and bottom surface(s) to position on such a horizontal surface, the beams or beam assemblies being linked by means (preferably only) above said bottom surface(s), the arrangement providing spacing (s) into which like beam(s) can substantially nest from below to allow base to base (i) nesting of beams or beam assemblies of different pallets or (ii) self nesting of the same pallet upon articulation, thereby to provide a reduction in the overall volume of (i) any pairing of pallets or (ii) any individual articulatable pallet respectively.

In preferred forms of the present invention three types of pallet (as herein defined) are contemplated, namely—

(a) a simple pallet of fixed size capable of repair, (b) a simple articulating form of pallet which by base to base self nesting upon articulation allows the prospect of carriage of the pallet in, for example, the trunk or boot of a car, and (c) a base to base nesting non articulating pallet which preferably offers up to 50% space saving in its nested condition over a non nested condition during a return journey and/or storage, and which might, optionally, include a telescopic section which allows for adjustment of the pallet preferably by elongating the pallet in a direction parallel to the beams which is transverse to the preferred opposite forklift or the equivalent tine receiving directions of the transverse openings of the beams and/or beam assemblies.

While variants of the pallet forms of the present invention will hereafter be described speaking of non articulating pallet forms which are extendible by means of telescopic extensions at each end or an articulating pallet which is extendible at at least one end, such forms of the invention introduce unnecessary complication and create greater difficulty and compliance with a fair range of Standards as set forth previously by reference to figures Table 1 and Table 2.

In a further aspect the invention consists in a pallet capable of being stably positioned on a horizontal surface (eg. the ground), of defining in use at least a skeletal support surface for a load and of defining a forklift or the like tine engageable surface or surfaces below said support surface and above any such horizontal surface approachable by tine(s) from at least two directions, each to allow the uplifting of said pallet from such a horizontal surface when in a load supporting condition, the pallet being characterised in that a plurality of substantially parallel beam or beam like assemblies, each fixed directly or indirectly in lateral juxtaposition to any neighbouring beam(s) or beam assembly (assemblies), define said support surface (at least in part) and bottom surface(s) to position on such a horizontal surface, the beams or beam assemblies being linked by means above said bottom surface(s), the arrangement providing spacing (s) into which like beam(s) can substantially nest from below to allow base to base (i) nesting of beams or beam assemblies of different pallets or (ii) self nesting of the same pallet upon articulation, thereby to provide a reduction in the overall volume of (i) any pairing of pallets or (ii) any individual articulatable pallet respectively, and being further characterised in that each said beam or beam assembly by means of transverse opening(s) through each said beam or beam assembly can accommodate a pair of forks from opposite horizontal directions, (ie. said at least two directions) when the pallet is positioned with its bottom surface(s) on a horizontal surface.

Preferably the laterally juxtaposed are of members or assemblies of transverse section(s) to said beams or beam like assemblies provide less spacing between them at the top thereof than between them at the bottom thereof thereby defining a greater area of support for any load to be carried thereon while providing beam to beam spacing from below to accommodate nesting.

Preferably each beam or beam assembly is spaced from those in juxtaposition adjacent to it at the top.

Preferably the spacing apart of the beams or beam assemblies at the plane of said support surface(s) is just greater than the lateral distance across the bottom surface(s).

Preferably each beam or beam assembly in transverse section is about 50% or less across laterally at its bottom surface when compared with laterally across its said support surface.

Preferably at least a primary means of location of the beams or beam assemblies in their parallel juxtaposed condition is a span at each end of the beams or beam assemblies that extends normal to the general plane of said support surface(s) in such a way and to such an extent as to still enable base to base nesting of type (i) or (ii).

Preferably each span is an end member that extends downwardly less than about 50% of the support surface to bottom surface distance.

Preferably said beams or beam like assemblies include laterally there through at least two said openings each to accommodate a tine being advanced normally to the longitudinal axis of any such beam in a plane to substantially parallel to the general plane of said top surface(s).

Preferably each support surface of each of at least a grouping of adjacent beams or beam assemblies is traversed by at least one linking runner or plate.

Preferably all of said beams or beam assemblies are traversed by at least one linking runner or plate.

Preferably there are at least two elongate runners that at least substantially span said beams or beam assemblies.

Preferably each runner is above a said opening.

Preferably said runner(s) and/or plate is or are fixed to at least most of said beams and/or beam assemblies.

Preferably said span(s) is or are no higher than said runner(s) or plate above said beams or beam assemblies.

In one embodiment range, each beam or beam assembly is extendable telescopically by means of a telescopic extension at at least one end thereof.

In some embodiments one end only is provided with a telescopic extension and telescopic extension member of a beam assembly is provided with lateral openings or gaps such as to allow in conjunction with openings in the non telescopic part of each beam or beam assembly the receiving of tines of a forklift in both an unextended or extended condition from a direction lateral to the longitudinal axis of said beam or beam assemblies.

In another embodiment range, said pallet is articulatable about a rotational articulation axis substantially normal to the longitudinal axis of said beams or beam like assemblies.

Preferably said beam assemblies as beam sets substantially on opposite sides of the articulation axis are mutually moveable as sets relative each other in a direction parallel to and/or along said articulation axis to allow base to base self mating.

Preferably one set is fixed to a hinge pin, shaft or the like which passes through part of each beam of each set at a region thereof of reduced thickness thereby providing a profile of each which will provide for abutment of shoulders when in its load carrying condition.

In extendible forms, preferably a span is directly or indirectly fixed to each beam assembly at a non telescopic end and another is directly or indirectly fixed to the telescopic extension set at the other end of the pallet.

Preferably each beam or beam assembly includes an extruded element or rotationally moulded element.

Preferably any such extruded element or rotationally moulded element has been subsequently provided with a said opening or openings.

Preferably at least one component of a beam or beam assembly is an extruded member defining (i) a top box section of any configuration, (ii) a bottom box section of any configuration, and (iii) links between said top and bottom box sections that substantially approximate an 'I' beam form using the top and bottom box sections. Preferably such a component in extendible forms slides within another extruded or rototationally moulded form of appropriate transverse section.

Preferably said openings are through said links only.

Preferably said bottom box section includes a fork tine deflecting ramp form below each said link.

Preferably said top box section has a lower surface to be uplifted by a fork tine passing through a said opening.

Preferably at least one end of each said extruded element or rotationally moulded element is fitted with an end cap.

Preferably any beam assembly extendable as to length is provided with means to pin the assembly to a length that complies with at least one Standard as hereinbefore defined.

Preferably the beam assemblies are extendable, there are two said openings and the longitudinal lengths of the two openings differ.

In some forms said pallet is the base of a cage or bin type structure or assembly.

Preferably said pallet is formed at least in part by a material other than wood.

In still another aspect the invention is a pallet of any of the forms hereinbefore described with reference to any one or more of the accompanying drawings.

Preferably a preferred transverse section of the beam(s) is substantially as hereinafter described.

The invention consists in the foregoing and also envisages constructions of which the following gives examples.

BRIEF DESCRIPTION OF DRAWINGS

One preferred form of the present invention will now be described with reference to the accompanying drawings in which.

BEST MODE OF CARRYING OUT THE INVENTION

In the preferred form of the present invention there is provided a pallet capable of being uplifted from preferably two different directions, both transverse to the preferred parallel beams or beam assemblies of the pallets of the present invention. Optionally two directions, ie. opposite directions parallel to such longitudinal axis of the beams or beam assemblies may also be provided for.

It is envisaged that by the base to base nesting of pallets of the present invention space savings of 50% are achievable. The space saving is achievable with the telescopic or non telescopic but non articulating form of the pallets of the present invention by appropriate base to base intermeshing. With the extending or non extending articulating forms of the pallets of the present invention the space saving occurs by means of base to base nesting of a single pallet upon such articulation, preferably after dislocation of the beams or beam assemblies by relative movement of the different end sets thereof relative to the articulation axis or at least mutual movement relative to such an axis.

The pallets of the present invention could be made from any appropriate materials and may indeed still include wood. It is envisaged that a metal such as aluminium can be used for one or more of the components as can of course any appropriate plastics material. A suitable plastics material is an appropriate HDPE and/or LDPE. If rotational moulding of any kind is utilised an appropriate PVC may indeed be used. Indeed some of the configurations of the present invention do not rule out the prospect of hybrid constructions mixing materials in single components and/or interchanging materials from component to component.

As used herein the term "pallet" refers to a platform or skeletal platform defining member with or without any cage, side walls or the like. While such a term will generally be used without reference to such a cage and/or side walls embodiments of the present invention do cover pallet forms which are erectable or remain erect as bins, cages or the like. In fact such cages, bins or the like can be de-mountable in form and thus the term "pallet" in accordance with the present invention envisages embodiments capable of being combined with components to be erected into cages, bins and the like.

Figure 1:
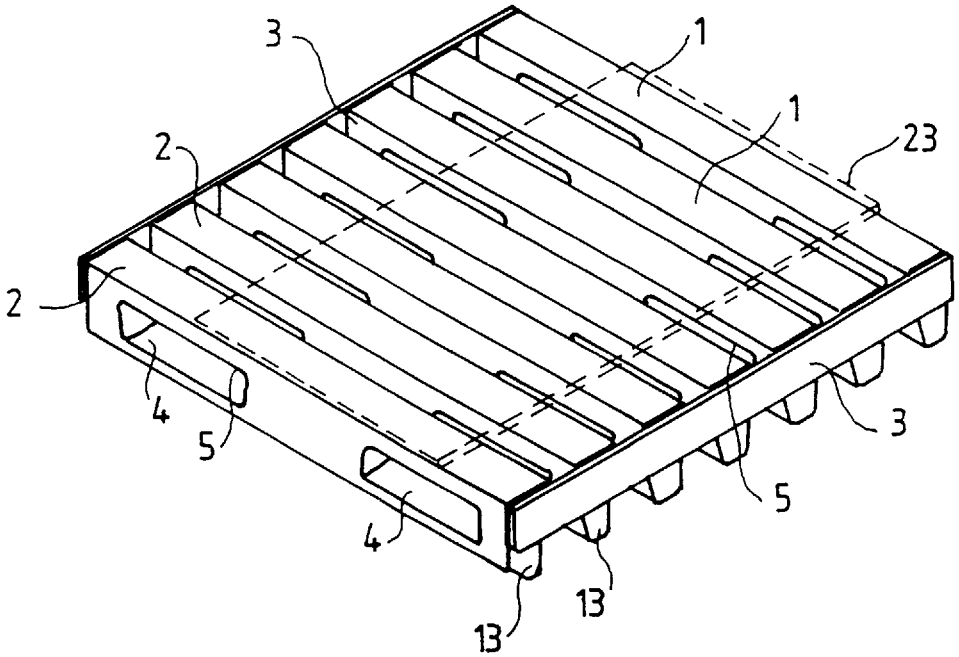
FIG. 1 which is a perspective view of a pallet (non articulating and non extendible) having openings as well beam spacing to allow uplifting by fork lift tines from two directions.

Preferred forms of the present invention will now be described with reference to the accompanying drawings in which FIG. 1 shows a simplified pallet in accordance with the present invention having a plurality of beams 1 aligning in a spaced interrelationship and defining at an upper surface 2 thereof collectively a skeletal support surface and defining at the lower surfaces thereof collectively a bottom surface or skeletal surface 3 capable of supporting the pallet stably on a horizontal surface. Generally the configuration of each beam as is the case in all preferred embodiments of the present invention is provided with a greater width (ie. transverse to the longitudinal axis of each beam 1) greater than the transverse width at the bottom surface 13 so as to better accommodate base to base nesting.

In the preferred form of the present invention save for any rack resistance providing means that may be interposed between some of the adjacent beams (non shown) at or near the top surfaces 2 thereof. Preferably the only fixing of the beams 1 in their parallel yet preferably spaced juxta position is by means of spanning members 3 at each end which in the preferred form of the present invention do not extend down beyond 50% of the distance between the support surface 2 and the bottom surface 13.

Figure 2:
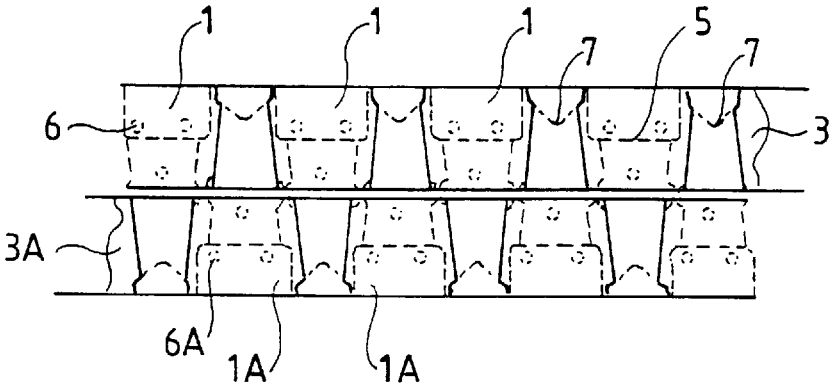
FIG. 2 shows the base to base nesting capability of two pallet such as shown in FIG. 1.

Positioned transversely through each beam 1 are tine receiving openings 4. So that tines can be received from either end or side of the pallet and provide a surface 5 against which an upper surface of the tines can engage in order to uplift the pallet. FIG. 2 shows how in some embodiments of the present invention the span or spanning members 3 or 3A can be affixed by appropriate screws eg. 6 or 6A respectively to the ends of the beams or beam assemblies 1 and 1A respectively.

As shown in FIG. 2 diagrammatically it can be seen that a 50% space saver when unused is achievable and indeed even in the nested form the whole structure is capable of being uplifted by the tines of a forklift or the equivalent lifting machinery by engagement through aligned openings 4 transversely of the nested parallel beams provided the top to bottom extent of each opening 4 with preferably a minimum of dropping from the fully nested condition of the beams 1A owing to engagement by the forklift tines against the surface 7 while lifting on surface 5 of the beams 1.

Figure 3:
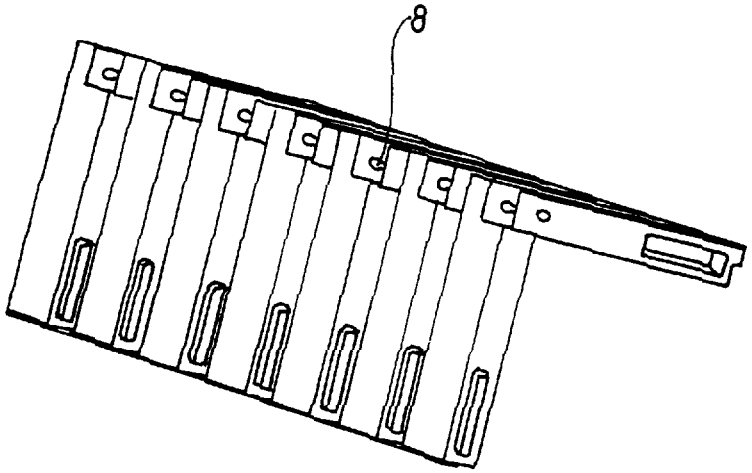
FIG. 3 is a perspective view of a pivotable pallet illustrated in a partly folded condition after axial movement of one set to clear an interlocking engagement about the articulation axis desirable when non articulated to a nesting condition.

FIG. 3 shows in a partially articulated form the beams or beam assemblies of an articulated form otherwise having all of the characteristics of the structure as shown in FIGS. 1 and 2 but having an articulation axis 8 to be described in further detail.

Figure 4:
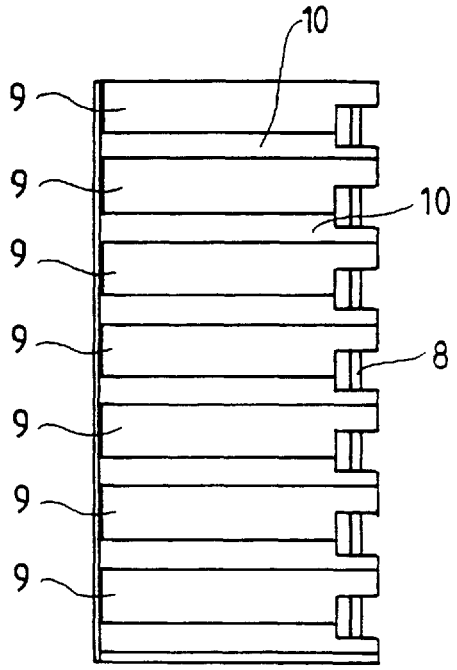
FIG. 4 is a top view of a pivotable pallet of FIG. 3 illustrated in a stored condition.

FIG. 4 shows from above the fully nested and thus 50% space saving form of the arrangement with the support surface defining surfaces of one half set (hereafter "set") of the beam regions (designated as 9) having the bottom surface defining surfaces of the other set interposed there between which is possible by virtue of the preferred dislocation of one set relative to the other by a sliding of that one set along the articulation providing shaft, pin or the like 8.

FIGS. 6C through 6F best shows such actual dislocation, one set relative to the other about the pin and articulation axis providing member 8.

Figure 8:
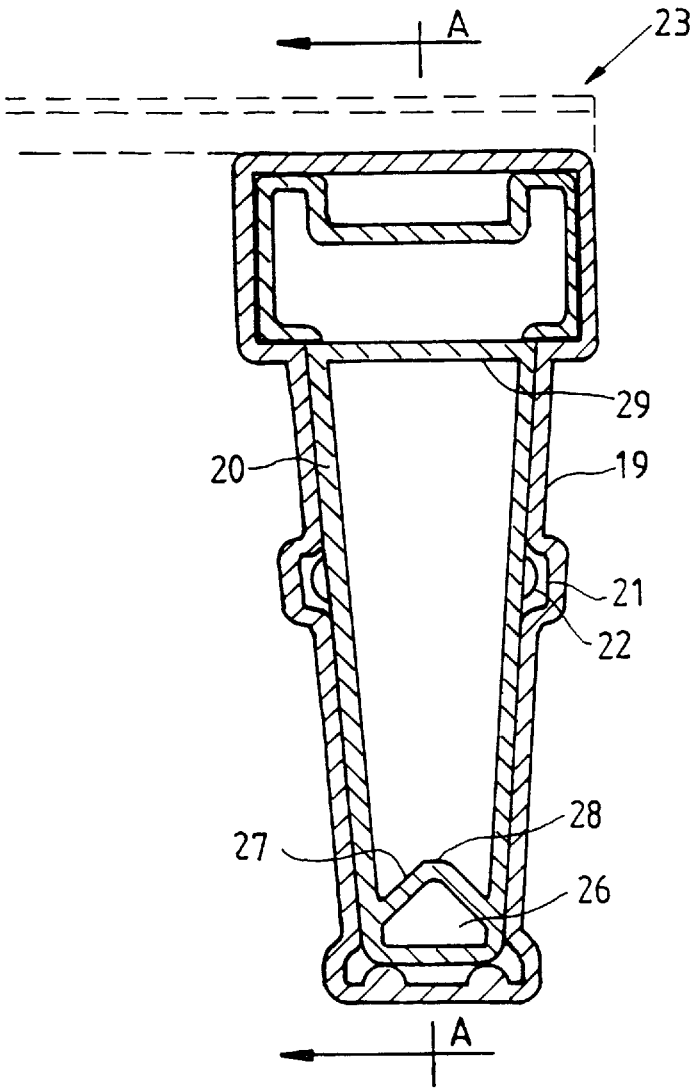
FIG. 8 is a cross sectional view through the preferred embodiment of a support beam assembly of the present invention which provides for a telescopic extension.

Even in the preferred articulating form as shown in FIG. 8, there is provided a spanning member 11 which equates to that referred to as 3 in relation to the embodiment of FIG. 1 but this time being fitted to the end of telescopic extensions 12 which are telescopically receivable within each of the articulating sets 13 and 14.

Figure 5:
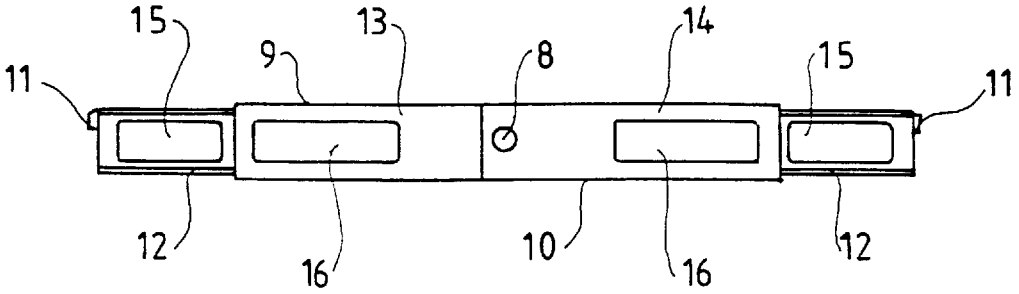
FIG. 5 is a side view of a pivotable pallet (less preferred) having two telescopic extensions shown in a opened condition having its end members extended.

Preferably the extension includes an opening or openings 15 such that when pressed fully home within the respective receiving beam sets 13 and 14 the opening 16 of a beam set 9 or 14 is not occluded from receiving a tine of a forklift. Similarly when extended as shown in FIG. 5, preferably each telescopic extension 12 includes a second opening there through which substantially corresponds to the opening 16 to allow even in the extended condition a forklift tine to be passed there through. Such a corresponding opening 17 can best be seen by reference to FIG. 6A.

Figure 6A:
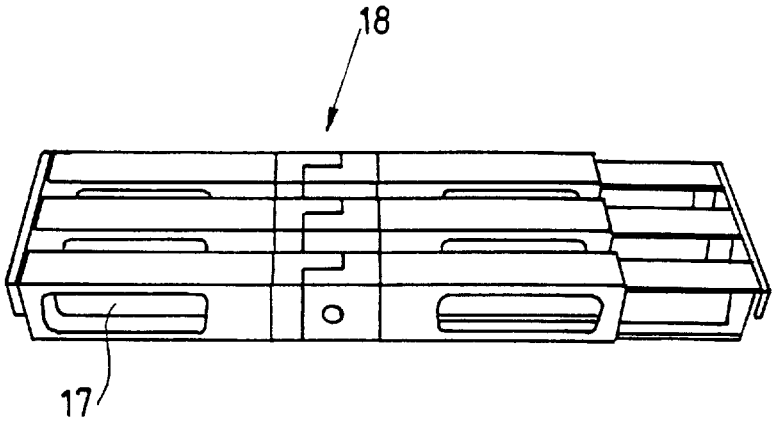
FIG. 6A shows a section of a pallet assembly in a carrying mode from above with telescopic extension members as a bank at one end fully extended but not occluding the tine-receiving openings of the beams.
Figure 6B:
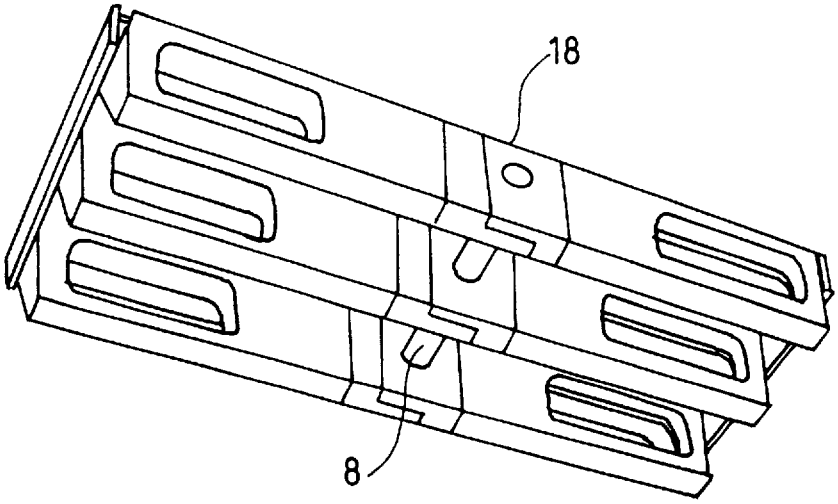
FIG. 6B is a view of the arrangement of FIG. 6A from below but having the extending member as a bank at one end unextended and telescopically inwardly of each beam the tine-receiving openings again not being occluded.
Figure 6C:
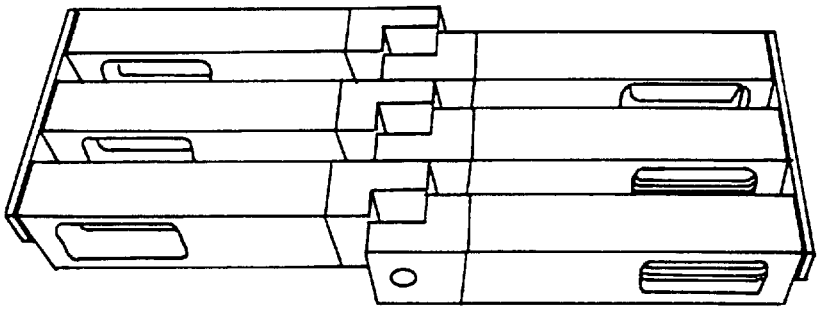
FIG. 6C is a view as in FIG. 6A but with the extending member inwardly, FIG. 6C showing each beam dislocated at its articulation zone by axial movement relative to the articulation axis of one set of beam regions so as to allow rotation and self nesting of part of each beam between corresponding parts of itself and a proximate beam.
Figure 6D:
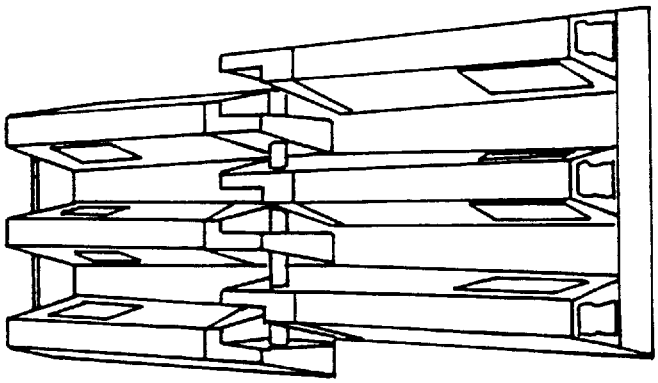
FIG. 6D is a view of the arrangement of FIG. 6C from below.
Figure 6E:
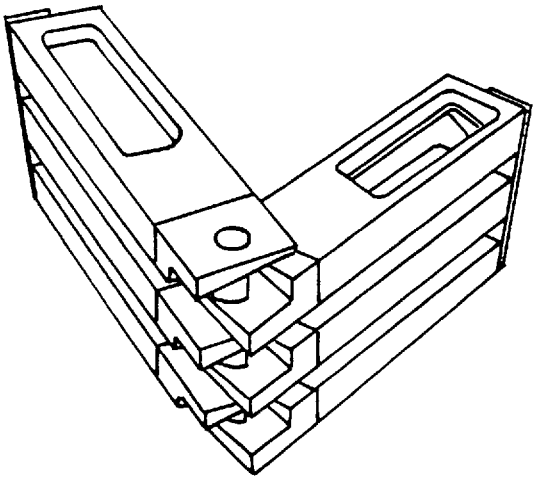
FIG. 6E shows the arrangement of FIGS. 6C and 6D being articulated.
Figure 6F:
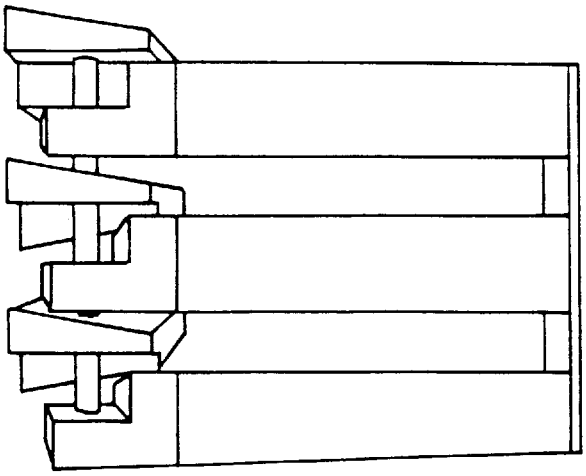
FIG. 6F is a similar view of the arrangement of FIG. 6E.

The offset arrangement which provides the abutments 18 best shown in FIGS. 6A and 6B are ideal for rigidity during normal load supporting and/or handling operations including while being supported by forklift.

Figure 6G:
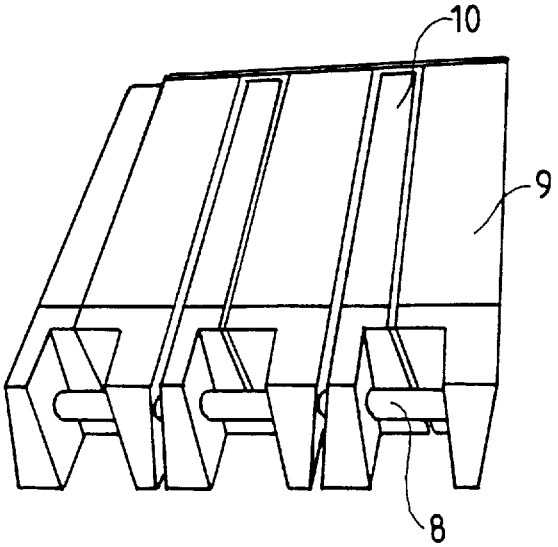
FIG. 6G shows the pallet assembly of FIGS. 6A–6F in its self-nesting, fully articulated non-load carrying mode which reduces the volume thereof by approximately 50%.

Preferably however one of the sets 13 or 14 is actually slidable on the pivot shaft or the like arrangement 8 so as to assume the variety of different conditions best illustrated by reference to FIGS. 6C through 6F until finally they drop into their self nesting base to base nesting form as shown in FIG. 6G.

Figure 7:
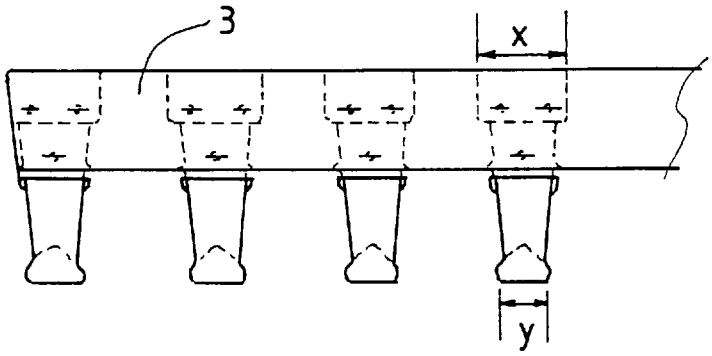
FIG. 7 is a partial end view of a pallet (of any of the preceding kinds) showing a preferred outline of several support beams.

FIG. 7 shows an end view of a preferred configuration of for example, an aluminium or plastic beam or beam assembly preferably having a width "X" which is greater than that of "Y" so at to allow the nesting shown in FIG. 2. Preferably "Y" is 50% or less the distance "X" and preferably the spacing between adjacent beams is such that "Y" can be fully received in the condition as shown in FIG. 2 irrespective of whether or not we are dealing with an articulating form or a base to base self nesting form.

While generally the beams as shown in FIG. 7 are convergent from the support surface to the bottom surface it is not necessarily for such convergence to be of a straight line, a line or straight curvature type as minor variations and configurations as depicted can easily be accommodated.

FIG. 8 shows a preferred form of structure for a telescopic form of the present invention where the beam assembly is capable of being formed by appropriate extrusion of a metal or metals and/or a plastics material such as previously set forth. In the arrangement as shown in FIG. 8 a beam component receives slidably there within another extrusion 20 not shown of course in this end view are the appropriate spanning member or members nor the lateral openings. It can be seen however that by means of channel defining regions 21 in member 19 there can be accommodation for protrusions and/or stops 22 in the inner member 20 to delimit the actual displacement of one member 19 or 20 relative to the other upon some localised defamation of the channel member 21.

Persons skilled in the art will appreciate the many options that are bound.

The lower region of the extrusion 20 consists of bevelled up stands 27 which when the tines of a forklift are entered through the openings 4 are able to deflect the tines (where not fully aligned with the openings) upwards to enter through the openings. The upper edge of the openings is defined by the upper section 28 of the bevelled up stands 27. The angle of the bevelled up stands 27 is defined by Standards. The distance between the upper region 29 of the openings 4 and the upper section 28 of the extrusion 20 is also defined by a Standard.

Figure 9:
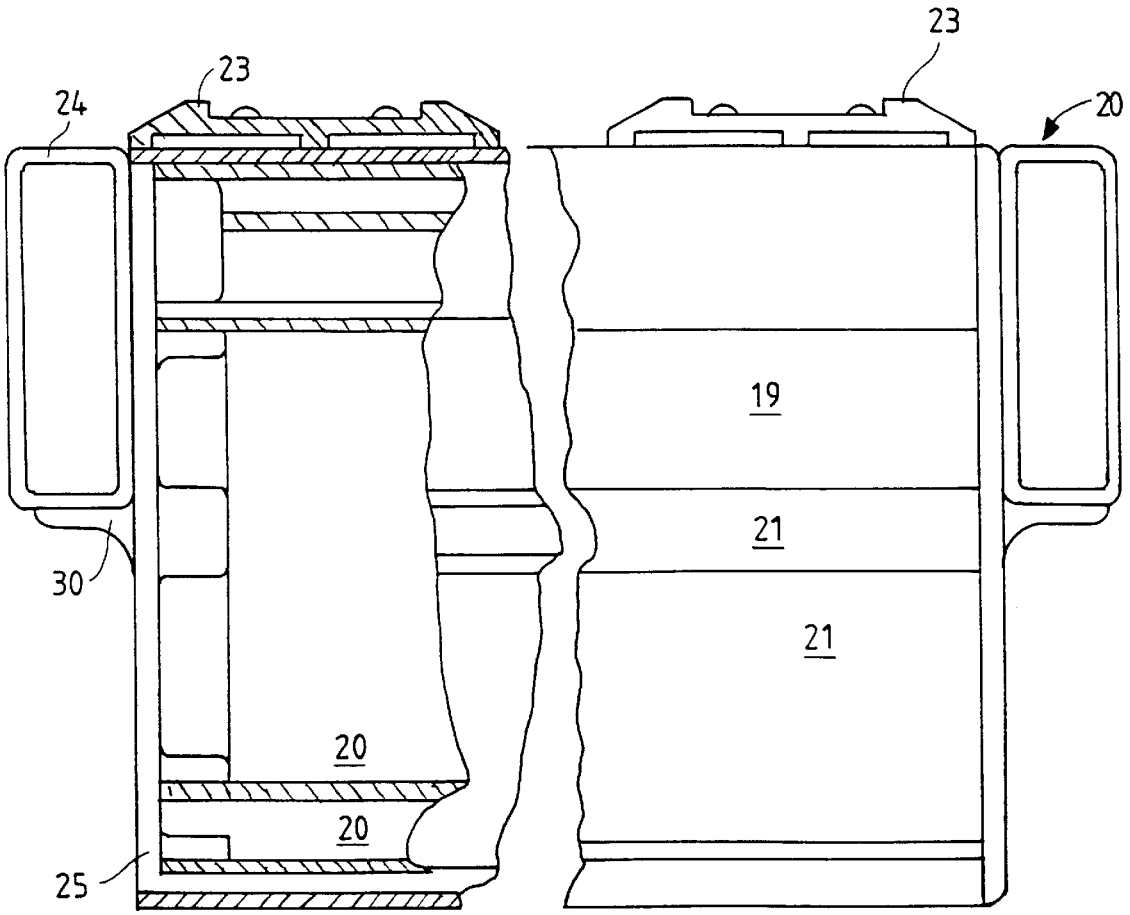
FIG. 9 is a side view and cross sectional side view through the end regions of a support beam of FIG. 8.

FIG. 9 shows a side elevational view, ie. laterally but in cross-section at AA of the arrangement of FIG. 8 but this time showing how at each end the beam sets of members 19 (particularly where being articulatable can be fixed together by a plurality of transversely extending rail members 23) shown in dotted outline in FIG. 8, these in addition to the spanning members 24 affixed by appropriate means at the ends of each of the extrusions 20. Most preferably the spanning members 24 are secured to each ends of extrusions 20 by a securing means which allows for the pallet to be repaired when damaged. Most preferably such securing means are screws, bolts or other penetrative types securing means. When a pallet or component of a pallet has been damaged, simple removal of the securing means will allow for the damage component to be removed and replaced by a replacement component which again is similarly secured to the pallet. Other forms of securement which are less desirable may include ultrasonic bonding, the use of plastics cement or solvent based glues. These however do not as easily allow for the components of a pallet to be replaced when damaged.

The lip 30 provided from the end cap 25 provides for additional strength and locateability of the spanning members 24.

Figure 27:
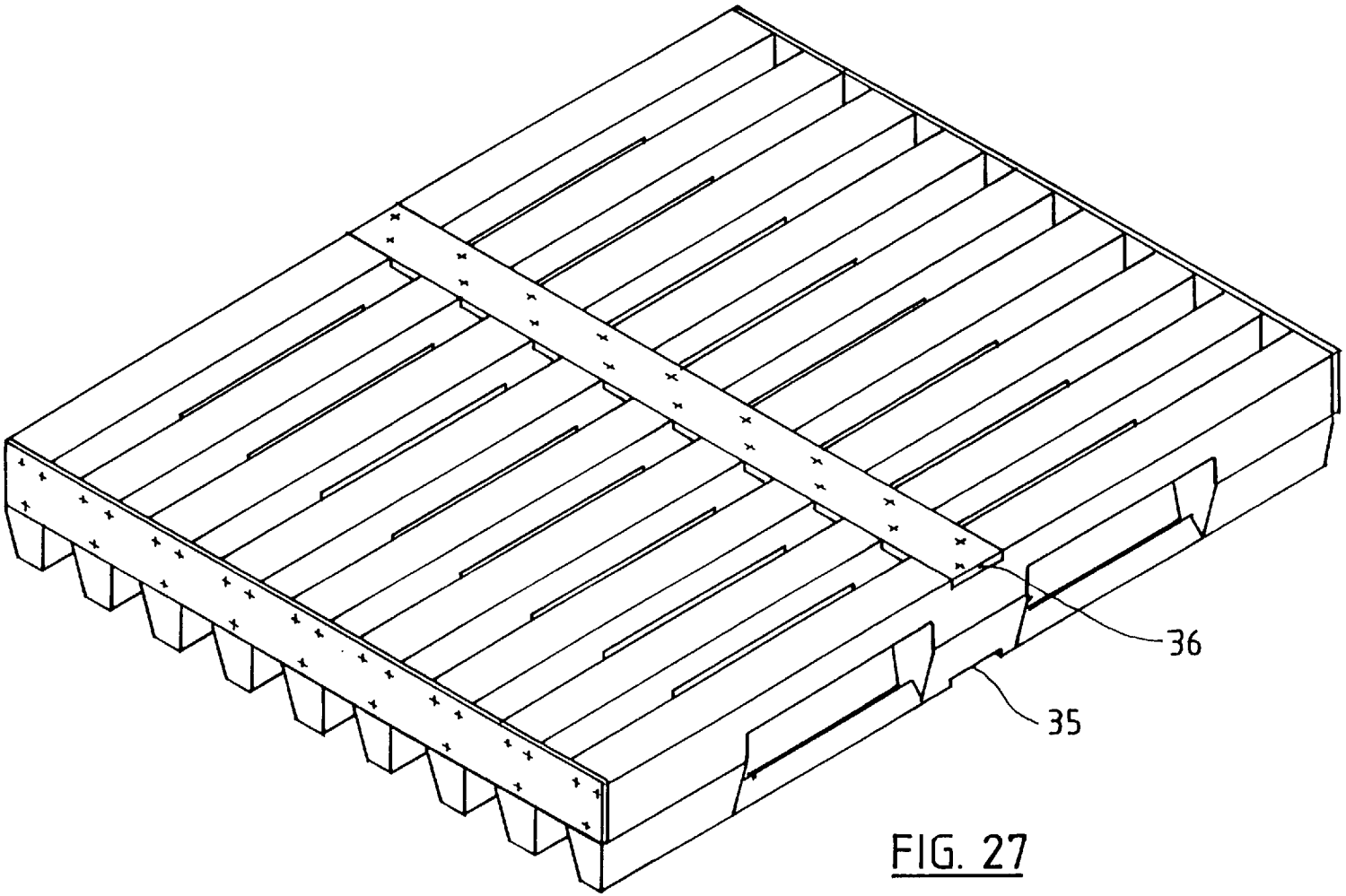
FIG. 27 is a perspective view of a hybrid pallet wherein beams are rotationally moulded from HDPE and having wood or aluminium stiffening braces.

The rail members 23 (also herein referred to as anti racking members 23) are secured to a pallet when necessary to provide strength and rigidity against any racking motion of the pallet. The anti racking members 23 locate onto the pallet most preferably perpendicular to the longitudinal direction of the beams. Most preferably such racking members are located on top of the surfaces 2 as defined in FIG. 1. Alternatively the locating of anti racking members between the beams is also possible. In such circumstances the anti racking members are made up of individual pieces of which locate between beams in a suitable place. From a storage point of view such configuration will require for recesses in the bottom region of each beam to be present to allow when in a stored condition the intermeshing of the beams and the anti racking members. In FIG. 27 the beams have been provided with a recess to allow the anti racking member to slot into the recesses 36. A person skilled in the art will realise that such anti racking members 23 may also lie diagonally across the beams of a pallet to prevent racking of the pallet. In the preferred form of the present invention, at least one anti racking member is provided. Several anti racking members may be provided lying at spaced intervals across the beams. Alternatively a single anti racking member 23 may consist of a sheet or plate of material which covers the entire or substantially entire upper surface area of the pallet. Anti racking members 23 may be made of wood, steel, aluminium, plastic or composite or the like.

Again from a repairability point of view it is desirable for the anti racking member(s) 23 to be secured to the pallet by a securing means which will allow removal of the anti racking member(s) 23 when damaged. Such fastening means are most preferably penetrative fastening means such as screws, bolts, or the like. Alternatively anti racking member (s) 23 may be secured to the pallet by a suitable adhesive means such as a plastic cement or solvent based glue or ultrasonic bonding. Furthermore the anti racking members also provide a support for products which are likely to sag between the beams. As an example bags of grain when supported by the pallet may sag between the beams and sag down to such a point where they are in line with the openings 4. This is undesirable as the entering of the tines into the openings may as a result puncture the bags or sacks. The use of anti racking members therefore also provides support for products or items carried by the pallet.

Preferably end caps are provided over each of the extrusions 20 such that the outer ends of each member 20 are supported by the bottom surface of the end cap structure 25 which in turn supports the spanning members 24. These end caps 25 can be screwed and/or adhered in place by appropriate plastics material suitable for the mating of the materials selected.

Figure 10:
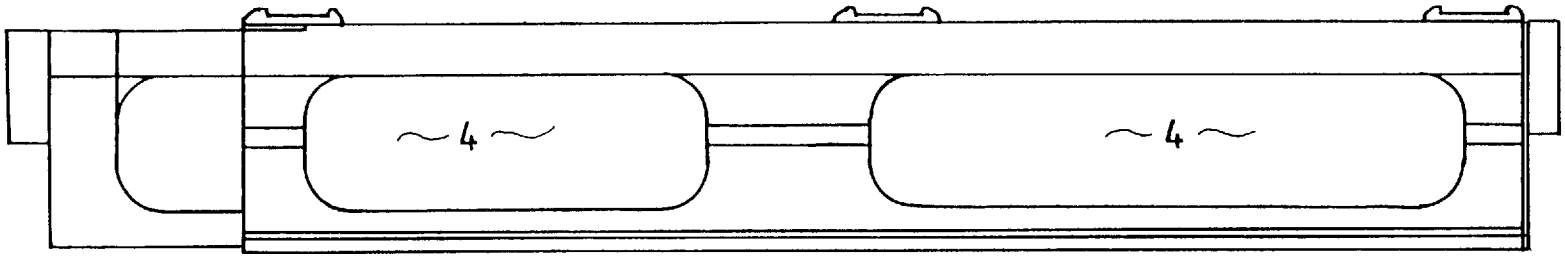
FIG. 10 is a side view showing further general detail of a pallet (with assemblies of FIG. 8 or 9) of the present invention.
Figure 11:
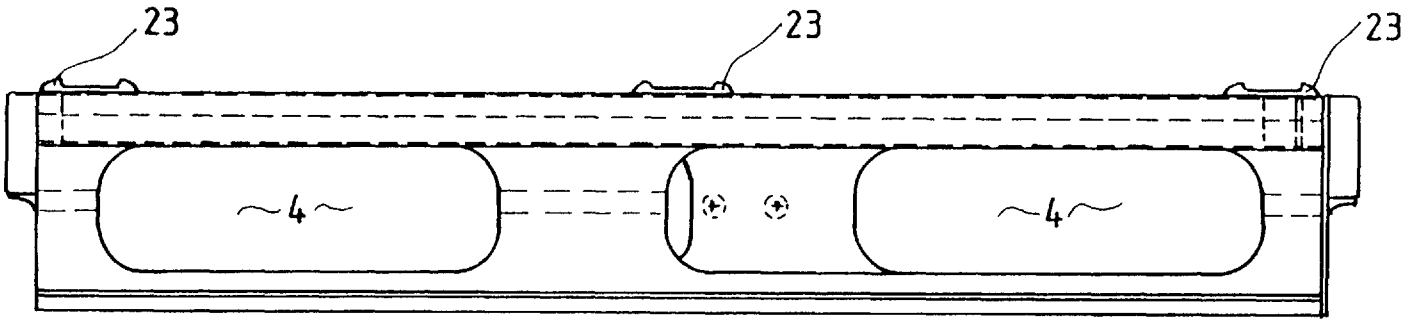
FIG. 11 is a side view of the pallet as shown in FIG. 10 in an unextended condition.

FIG. 10 shows an arrangement of a non articulating kind of a pallet as depicted in FIG. 1 but with a one way extensions partially extended, the non extendible parts of the pallet being spanned by three top rail members of the kind depicted as 23 in FIGS. 10 and 11.

FIG. 11 shows the arrangement of the non articulating kind of pallet as shown in FIG. 10 with no extensions extended.

The pallet of FIGS. 10 and 11 has been designed to comply with Standards as herein described. The openings 4 of the pallet in an unextended condition as shown in FIG. 11 comply in size and spacing with the Standard for a pallet of width equal to the pallet illustrated in an unextended condition as shown in FIG. 11. The same pallet in an extended condition as shown in FIG. 10 has openings 4 which comply in shape and spacing with a Standard for a pallet of size as per the pallet illustrated in FIG. 10 in an extended condition. Hence in an unextended condition as shown in FIG. 11 the pallet when viewed from the side is not of a symmetric configuration. The identical pallet complies with the Standards for size and spacing of the opening 4 in both an extended and unextended condition.

Figure 12:
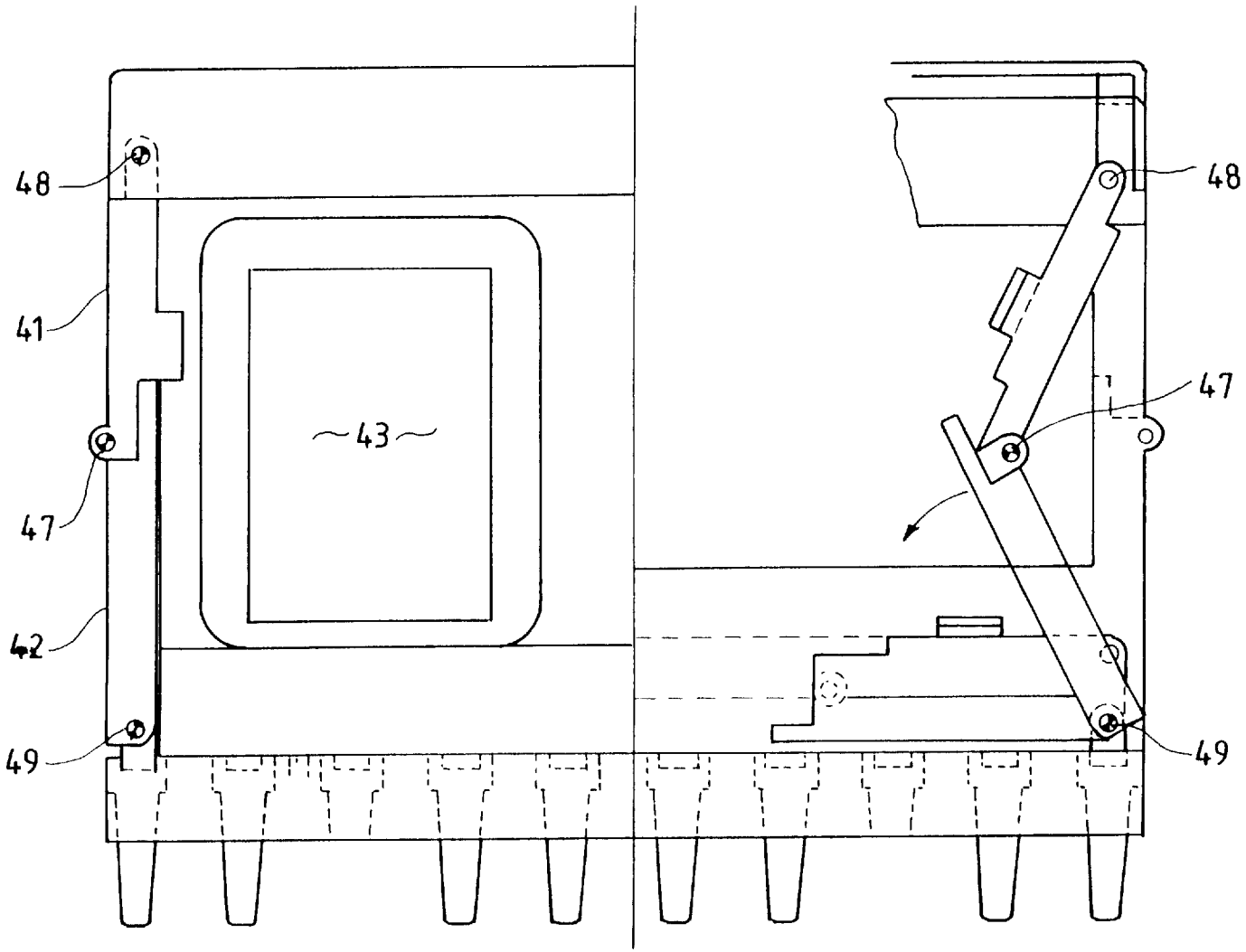
FIG. 12 is a side view of a basic four-way pallet carrying a collapsable crate, one half of the figure illustrating the external detail of the crate, the other half illustrating the internal detail and workings of the collapsing mechanism of the crate.
Figure 13:
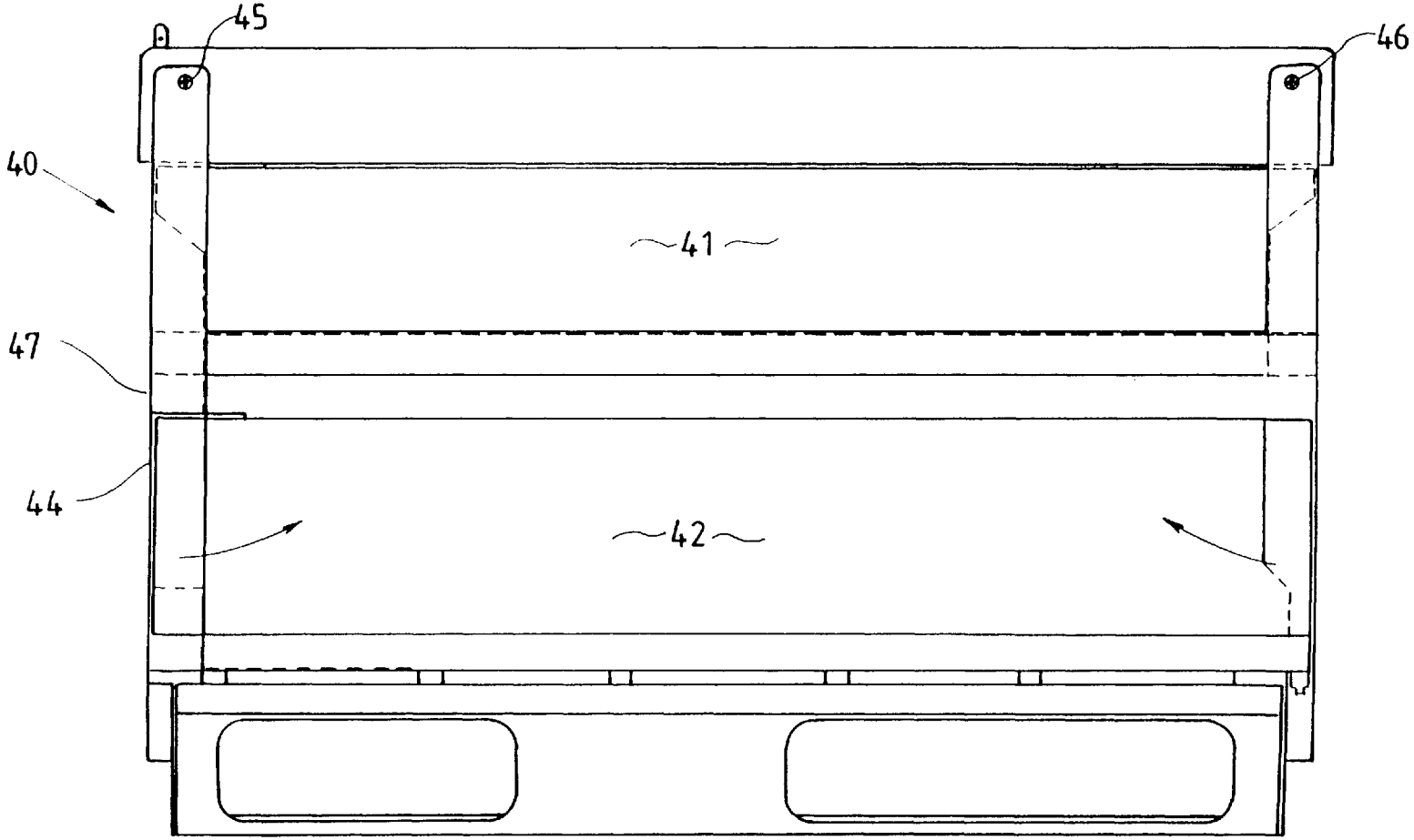
FIG. 13 is an end view of a basic four-way pallet carrying a collapsable crate in a fully erected condition.

Illustrated in FIG. 13 there is a pallet as hereinbefore described on to which a cage 40 is mounted in an erected condition. The side view illustrated in FIG. 13 shows the cage having two pairs of side walls 41 and 42 located one above the other, the other pair located on the opposing side. The adjacent end walls 43 and 44 form the other boundaries of the cage. The cage is movable from a fully erected condition as shown in FIG. 13 to a collapsed condition by the pivoting of the side walls 41 and 42 relative to each other as shown in FIG. 12. Prior to the moving of the cage from a fully erect condition to a collapsed condition, the end walls 43 and 44 are collapsed inwardly and upwardly about pivots 45 and 46. Subsequently the cage is able to move to a collapsed condition by the pivoting of the side walls about pivots 47, 48 and 49. The ability of the cage to collapse from a fully erect condition to a collapsed condition reduces the space requirement of the pallet and cage when not in use. This is a particular advantage when storing the crate as less space is required for such storage.

The sectional view of FIG. 12 illustrates the cage in three conditions, a first in a fully erect condition, the second in a fully collapsed condition and the third in an intermediate condition.

Figure 14:
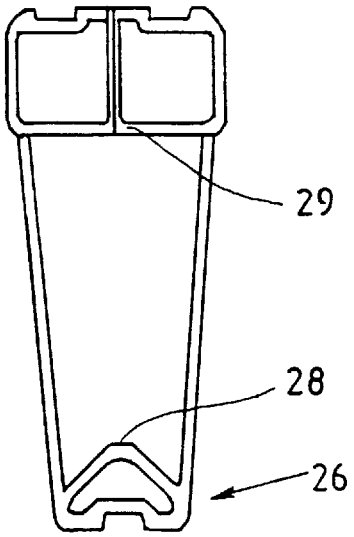
FIG. 14 is a sectional view through an alternative configuration of a beam, the beam manufactured by extrusion.

FIG. 14 illustrates an alternative configuration of a beam element. Again the lower region 26 has bevelled up stands and the distance between the upper section 28 and upper region 29 is defined by Standards.

Figure 15:
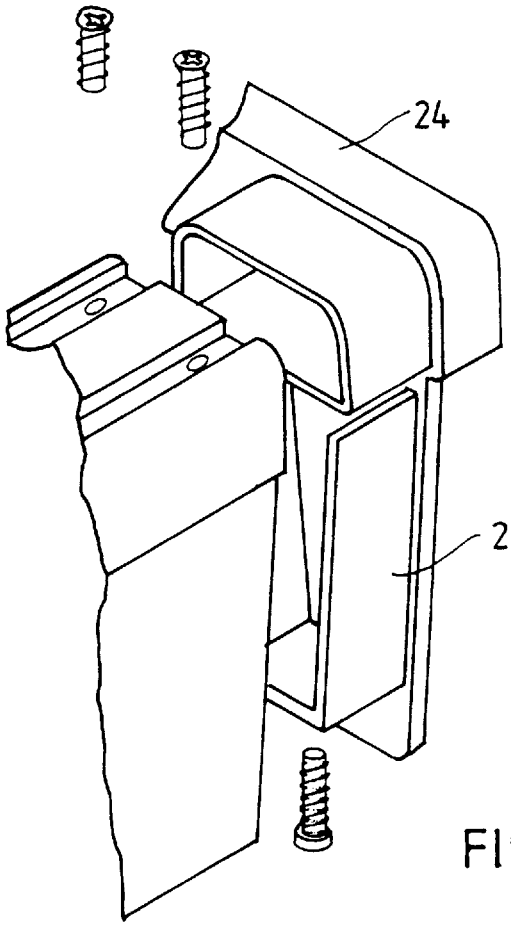
FIG. 15 is a partial perspective view of an end of a beam and spanning member illustrating these components in an exploded arrangement.

FIG. 15 is a perspective view illustrating how an end cap 25 is able to be inserted into a beam element and secured thereto by suitable securing means such as screws. Illustrated in FIG. 15 is an end cap which forms an integral part of a spanning member 24. Most preferably this is a moulding of a suitable plastics material such as HDPE.

Figure 16:
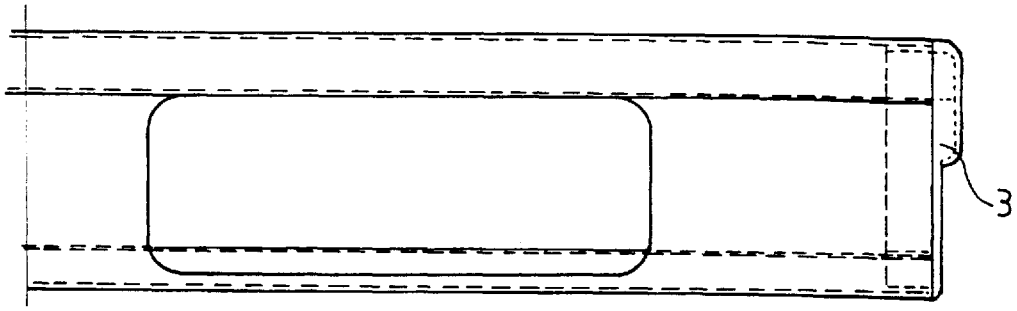
FIG. 16 is a partial side view of the beam of FIG. 14 also illustrating the spanning member.

FIG. 16 is a partial side view of a beam element end cap and spanning member of FIGS. 14 and 15.

Figure 17:
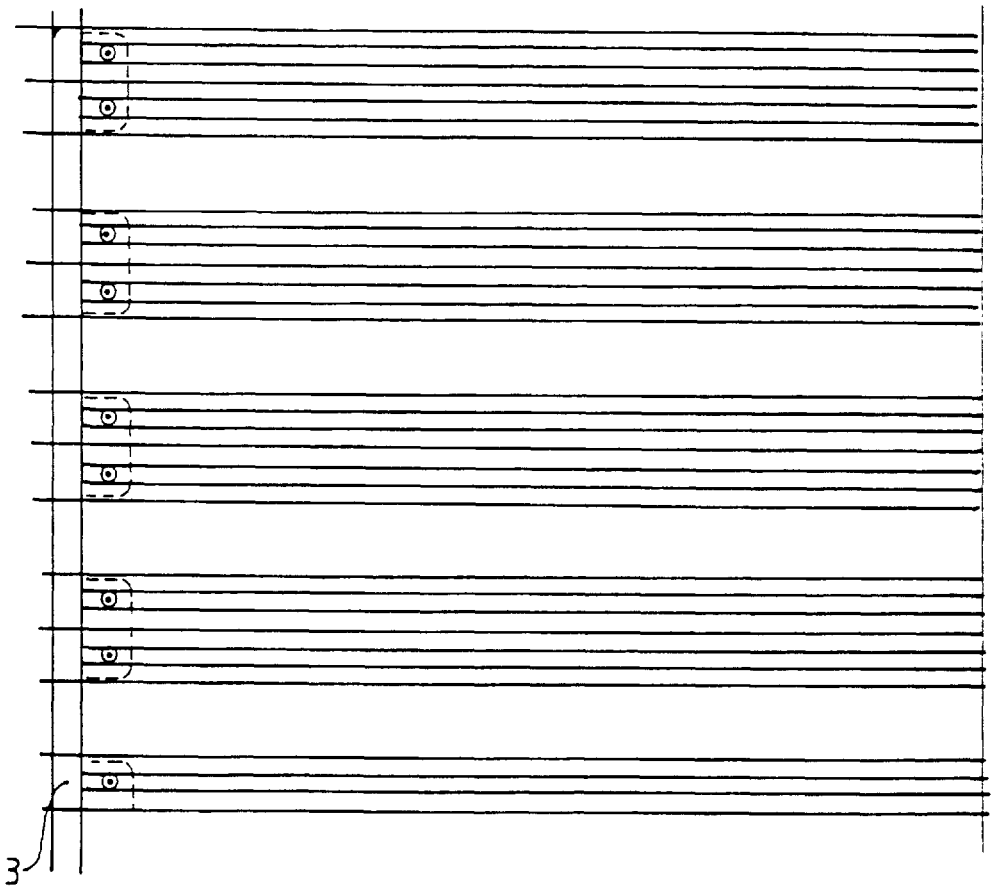
FIG. 17 is a plan view of a parality of beams of FIG. 14 and also showing the spanning member.

FIG. 17 is a partial plan view of the components shown in FIGS. 14, 15 and 16 illustrating several beam elements in a parallel side by side configuration.

Figure 18:
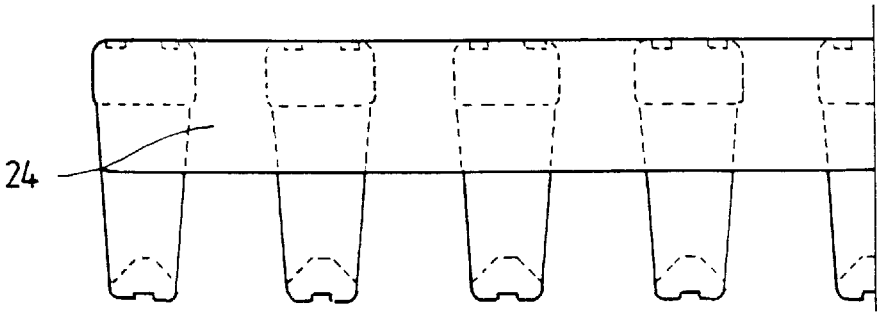
FIG. 18 is an end view of a parality of beams of FIG. 14, also illustrating the spanning member.

FIG. 18 is a partial end view of several beam elements showing their repeating side by side configuration.

Figure 19:
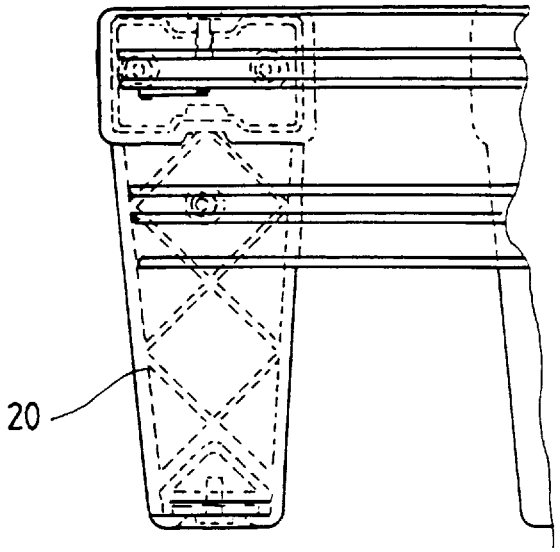
FIG. 19 is an end view of a beam of a hybrid pallet.
Figure 20:
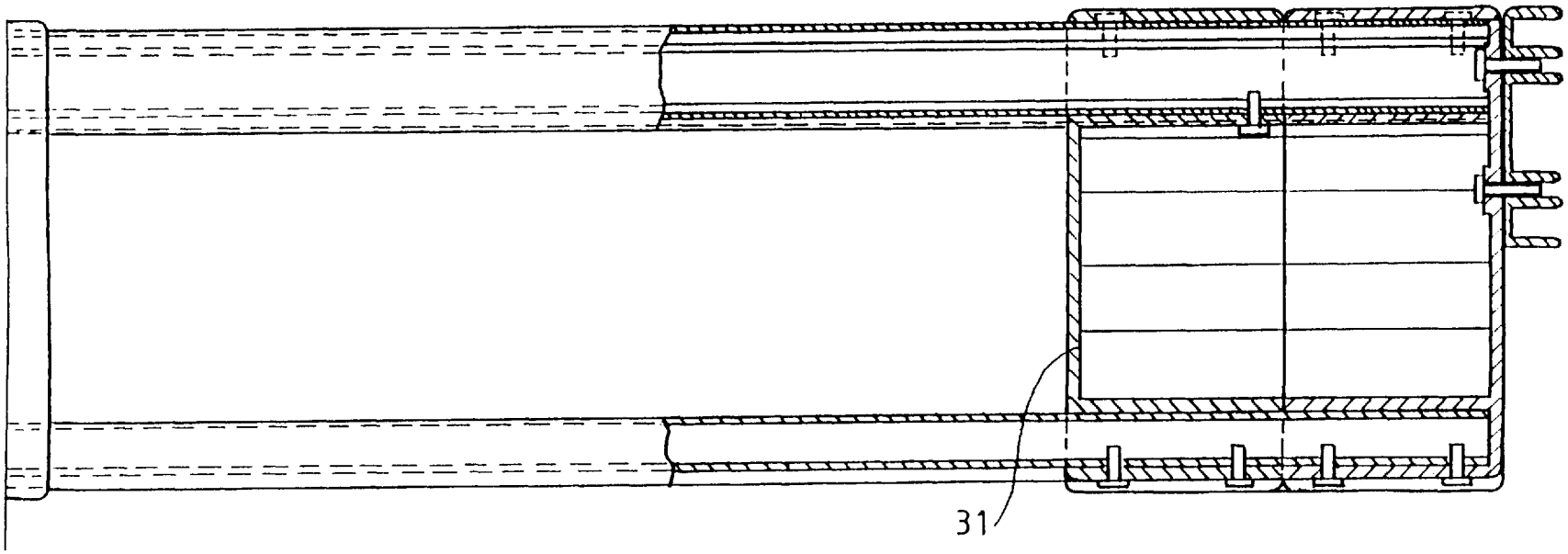
FIG. 20 is a partial side view of th beam and spanning member as shown in FIG. 19.
Figure 21:
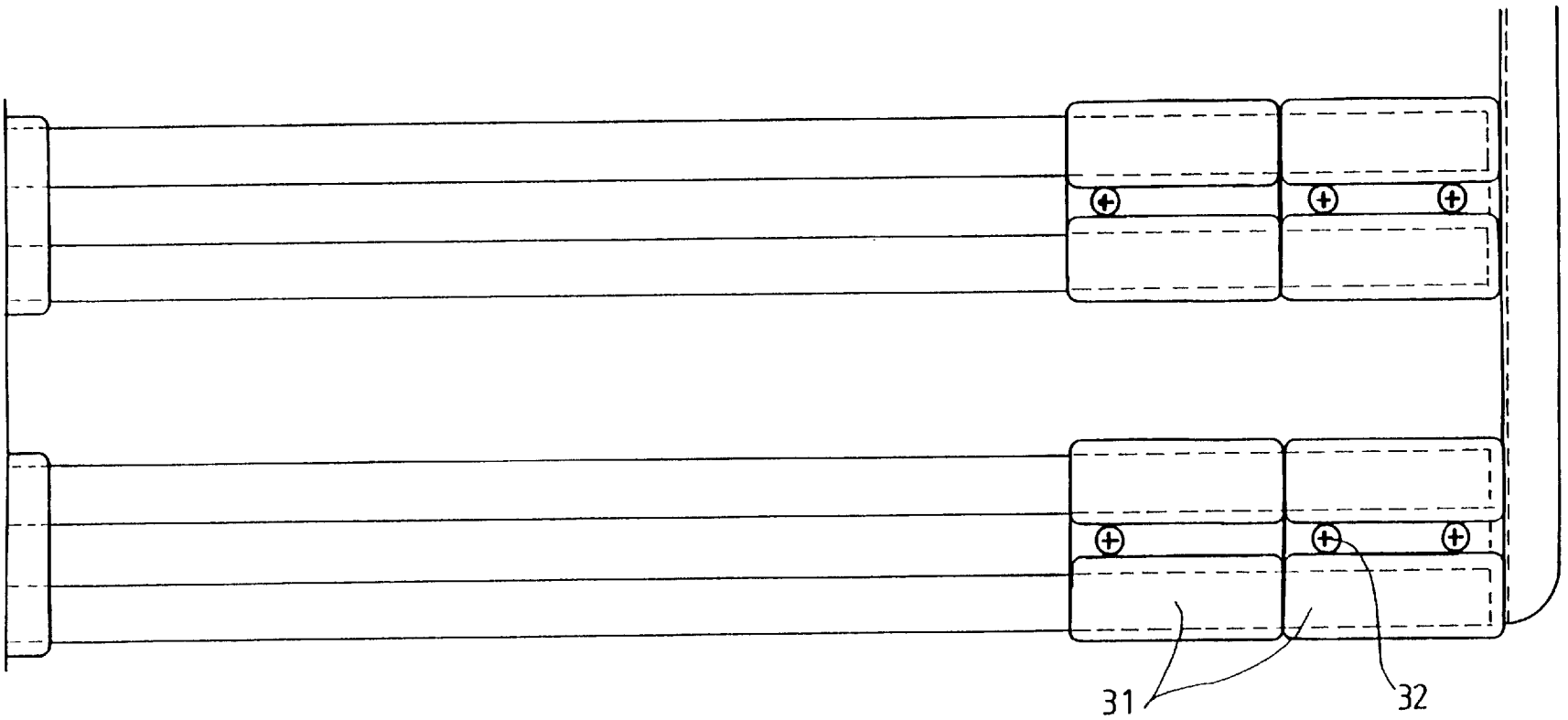
FIG. 21 is a partial beam plan view of two beams and a spanning member as shown in FIGS. 19 and 20.

FIG. 19 is an end view of a beam of a pallet consisting of components of different material. The beam element extrusion is most preferably made of aluminium for steel or a like. Similarly the spanning member is of a similar material. Associated with the beam elements are mouldings 31 as shown in FIGS. 20 and 21 which are secured to the extrusions 20 by suitable fixing means. Most preferably such means are penetrative fixing means such as screws or bolts 32. Again, the use of such penetrative fixing means allows for components of the pallet to be removed when damaged, thereafter being replaced by new components.

Figure 22:
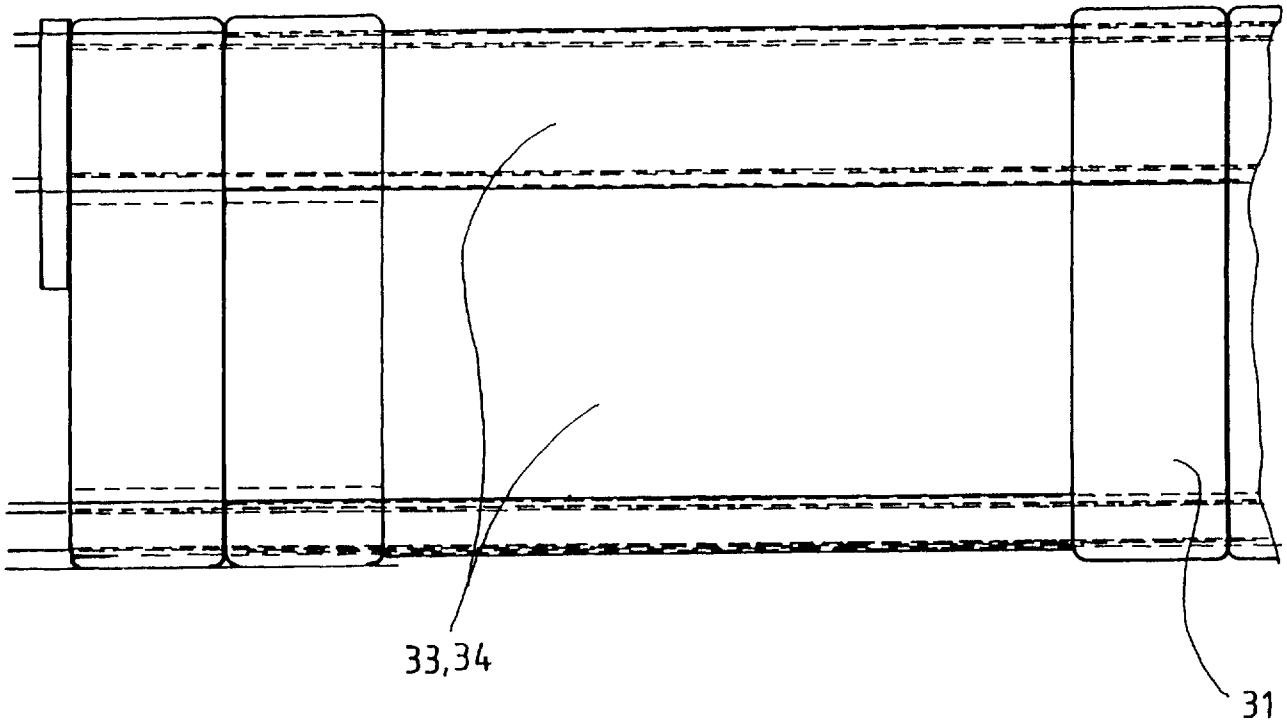
FIG. 22 is a a partial side view of a plastic/steel hybrid extending pallet.

FIG. 22 is a partial side view of a hybrid pallet consisting of a plastic/metal. The metal members 33 and 34 are telescopically slideable relative to each other to thereby provide the ability of the pallet to be extended. Mouldings 31 provide a suitable spacing to allow the extendibility of the pallet.

Again the design of the lay out of the components of the beam is such as to comply with the Standard.

Figure 23:
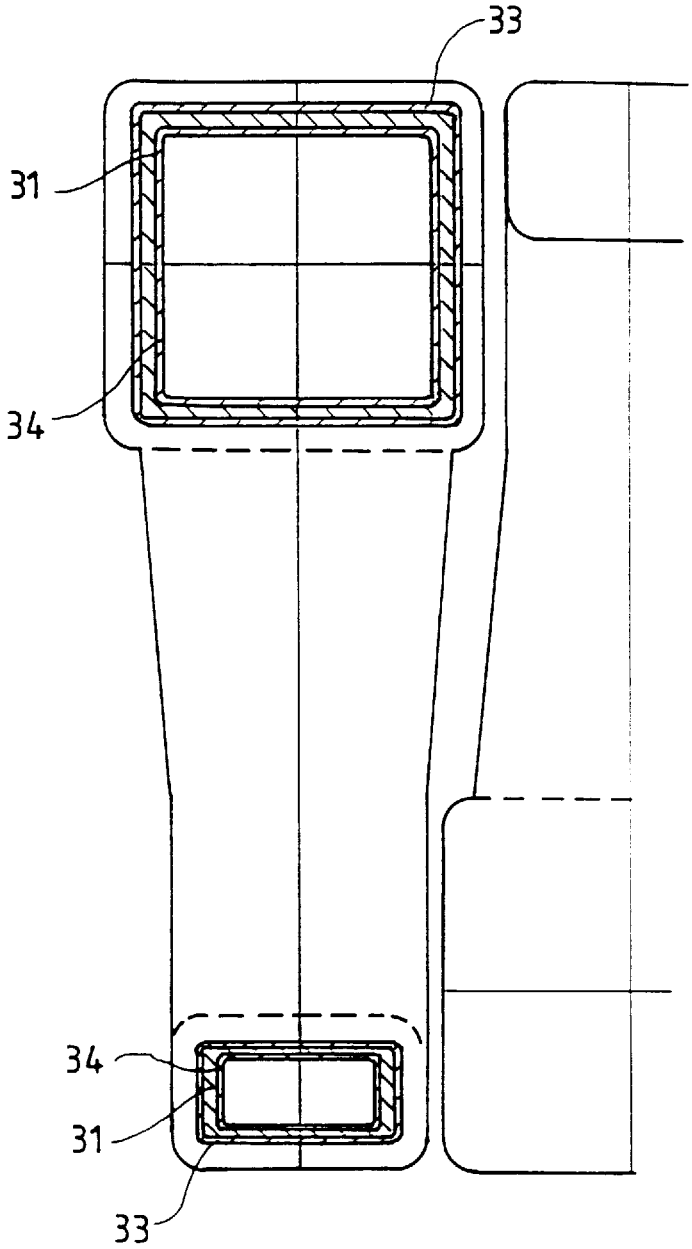
FIG. 23 is an end view of two beams in a stored condition of pallets as shown in FIG. 22.

FIG. 23 illustrates the nestability of beams of this type of configuration to allow pallets to be stored in a space saving manner.

Figure 24:
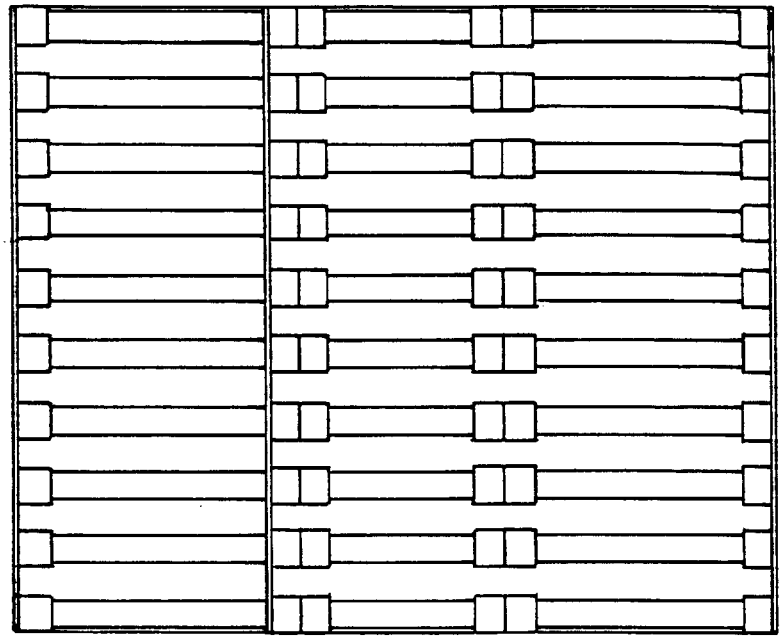
FIG. 24 is a general plan view of a pallet of FIGS. 22 and 23.
Figure 25:
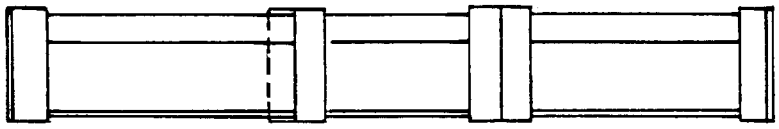
FIG. 25 is a side view of a pallet of FIGS. 22, 23 and 24.
Figure 26:
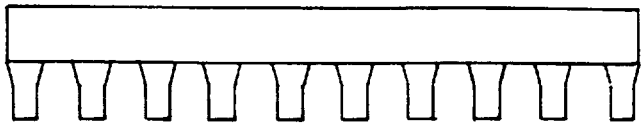
FIG. 26 is an end view of a pallet of FIGS. 22, 23, 24 and 25.

FIGS. 24, 25 and 26 are general plan, side and end views respectively of pallets having components shown in FIGS. 22 and 23.

FIG. 27 is a perspective view of a hybrid pallet having most preferably rotationally moulded beams and having wooden or aluminium spanning members and anti racking members.

Again, most preferably the spanning members and anti racking members are secured to the beams by securing means which allow for removal from the beams when damaged.

Figure 28:
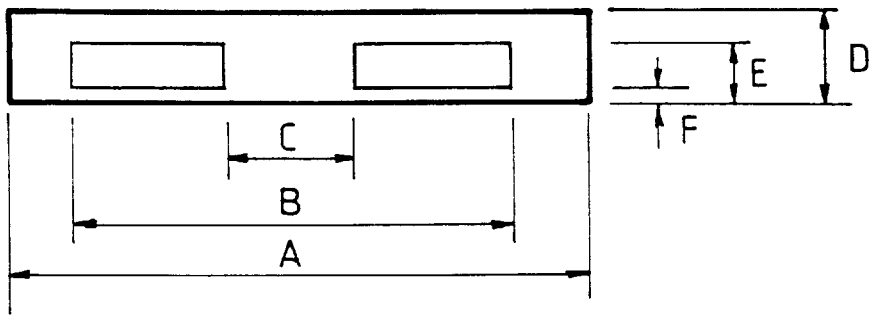
FIG. 28 shows for the purpose of standards the measurements referred to in Table 2 hereof.

FIG. 28 shows for the purpose of Standards the measurements referred to Table 2 herein.

The pallets allow for the use of slip sheets or transfer sheets to provide a means of transferring items carried by a pallet from a pallet.

Illustrated in FIG. 12 is a pallet having two partial beam members which do not extend to the same depth as the other beam members. Such a relief in the sequence of beam elements provides a relief into which a tine of a forklift is able to be inserted. This allows for the pallet to be lifted from 2 perpendicular directions. This is useful in situations where a restricted space does not allow for a forklift to approach the pallet from a certain direction. The provision of the release in the pallet provides for an alternative direction by which the pallet may be lifted.

Although not every pallet drawn or described herein has such a relief a person skilled in the art will realise that the provision of such a relief is applicable to each shape and configuration of a pallet described herein.

What I claim is:

1. A pallet capable of being stably positioned on a horizontal surface, of defining in use at least a skeletal support surface for a load and of defining a tine engageable surface or surfaces below said support surface and above any such horizontal surface approachable by at least one tine from at least two directions, to allow the uplifting of said pallet from the horizontal surface when in a load supporting condition, the pallet comprising two beam assemblies, each of a plurality of substantially parallel longitudinal beams linked to fix directly or indirectly neighboring beams in lateral juxtaposition, said two beam assemblies capable of articulation relative to each other about an axis substantially transverse to a longitudinal direction of said beams, said beams of said two assemblies providing spacings into which like beams can substantially nest from below to allow in a first mode, base to base nesting of beams of different pallets, and in a second mode, base to base self nesting of said beams of said beam assemblies upon articulation, thereby to provide a reduction in the overall volume of (i) any pairing of pallets in said first mode or (ii) any individual articulated pallet in said second mode, wherein said pallet by means of at least one transverse opening through each of the beam assemblies can accommodate a fork from opposite horizontal directions, when the pallet is positioned on a horizontal surface.

2. A pallet as claimed in claim 1 wherein members or assemblies of at least one transverse section to said beams are laterally juxtaposed to provide less spacing between the members or assemblies at a top thereof than between the members or assemblies at a bottom thereof thereby defining a greater area of support for any load to be carried thereon while providing beam to beam spacing from below to accommodate nesting.

3. A pallet of claim 1 wherein each beam of each of said beam assemblies is spaced from adjacent beams in juxtaposition.

4. A pallet of claim 3 wherein a transverse distance across each of said two beam assemblies at at least one of said support surfaces is greater than a transverse distance across at least one of the bottom surfaces.

5. A pallet of claim 1 wherein each beam in transverse section is about 50% or less across laterally at a bottom surface when compared with laterally across said support surface.

6. A pallet of claim 1 wherein at least a primary means of linking of the beams of each of said beam assemblies in a parallel juxtaposed condition is a transverse spanning member at a distal end of the beams away from said articulated end and which extends downwardly from or adjacent at least one of said support surfaces towards said bottom surface in such a way and to such an extent as to still enable base to base nesting in said first mode or in said second mode.

7. A pallet of claim 6 wherein each spanning member is an end member that extends downwardly less than about 50% of the support surface to bottom surface distance.

8. A pallet of claim 6 wherein said spanning members are no higher than at least one of said runners or plate above said beams.

9. A pallet as claimed in claim 1 wherein said beams of each said two beam assemblies include laterally there through at least one said opening each to accommodate a tine being advanced in a plane substantially parallel to said horizontal surface.

10. A pallet as claimed in claim 1 wherein each support surface of each of at least a grouping of adjacent beams is traversed by at least one linking runner or plate.

11. A pallet as claimed in claim 9 wherein all of said beams of each of said beam assemblies are traversed by at least one linking runner or plate.

12. A pallet of claim 10 wherein there are at least two elongate runners that at least substantially span said beams.

13. A pallet of claim 12 wherein each runner is above one said opening.

14. A pallet of claim 10 wherein each of said runners and/or plate is or are fixed to at least most of said beams.

15. A pallet as claimed in claim 1 wherein each beam or beam assembly is extendable telescopically by means of a telescopic extension at at least one end thereof.

16. A pallet as claimed in claim 15 wherein one end only is provided with a telescopic extension and telescopic extension member of a beam assembly is provided with lateral openings or gaps such as to allow in conjunction with said at least one opening in the non telescopic part of each beam the receiving of tines of a forklift in both an unextended or extended condition from a direction lateral to the longitudinal axis of said beams.

17. A pallet of claim 15 wherein a spanning member is directly or indirectly fixed to each of said two beam assemblies at a non telescopic end and another is directly or indirectly fixed to the telescopic extension set at the other end of the pallet.

18. A pallet as claimed in claim 1 wherein an axle or hinge pin defining a rotational articulation axis is provided intermediate of said two beam assemblies, said two beam assemblies being articulatable about said rotational articulation axis substantially normal to the longitudinal direction of said beams.

19. A pallet as claimed in claim 18 wherein said two beam assemblies substantially on opposite sides of the articulation axis are mutually moveable as sets relative each other in a direction parallel to and/or along said articulation axis to allow base to base self mating.

20. A pallet as claimed in claim 19 wherein the lateral juxtaposition of the beams of one of said beam assemblies is arranged to provide a pairing of beams to the other of said beam assemblies, each pairing of beams at and adjacent the articulatable axis having a region of reduced width in a transverse direction so as to be locatable with a complementary recess region defined by a reduced width region in a transverse direction of the opposite of pairing of beams, one of said beam assemblies being fixed to said axle or hinge pin which passes through part of each of said two beam assemblies at said region thereof.

21. A pallet of claim 1 wherein each beam includes an extruded element or rotationally moulded element.

22. A pallet of claim 21 wherein any such extruded element or rotationally moulded element has been subsequently provided with one said opening or openings.

23. A pallet of claim 21 wherein at least one end of each said extruded element or rotationally moulded element is fitted with an end cap.

24. A pallet of claim 1 wherein at least one component of a beam or beam assembly is an extruded member defining (i) a top box section of any configuration, (ii) a bottom box section of any configuration, and (iii) links between said top and bottom box sections that substantially approximate an "I" beam form using the top and bottom box sections.

25. A pallet of claim 24 wherein said openings are through said links only.

26. A pallet of claim 25 wherein said bottom box section includes a fork tine deflecting ramp form below each said link.

27. A pallet of claim 24 wherein said top box section has a lower surface to be uplifted by a fork tine passing through a said opening.

28. A pallet of claim 1 wherein any of said two beam assemblies is extendable as to length.

29. A pallet as claimed in claim 1 wherein said pallet is formed at least in part by a material other than wood.

* * * * *